US005608495A

United States Patent [19]

Kitakubo et al.

[11] Patent Number: 5,608,495

[45] Date of Patent: Mar. 4, 1997

[54] IMAGING DENSITY CONTROL APPARATUS

[75] Inventors: Hideo Kitakubo, Toyokawa; Suguru Hamamichi, Shinshiro; Mineo Yamamoto, Toyohashi, all of Japan

[73] Assignee: Minolta Camera Kabushiki Kaisha, Osaka, Japan

[21] Appl. No.: 175,543

[22] Filed: Dec. 30, 1993

[30] Foreign Application Priority Data

Jan. 1, 1993 [JP] Japan ..... 5-014416
Nov. 19, 1993 [JP] Japan ..... 5-314246

[51] Int. Cl.[6] ..... G03G 21/00

[52] U.S. Cl. ..... 399/72; 399/59

[58] Field of Search ..... 355/208, 214, 355/246, 326 R, 327

[56] References Cited

U.S. PATENT DOCUMENTS

| | | | |
|---|---|---|---|
| 4,624,547 | 11/1986 | Endo et al. | 355/208 |
| 4,711,569 | 12/1987 | Nishimori et al. | 355/214 X |
| 4,879,576 | 11/1989 | Naito | 355/214 |
| 4,982,232 | 1/1991 | Naito | 355/208 |
| 5,099,279 | 3/1992 | Shimizu | 355/208 |
| 5,134,438 | 7/1992 | Nakashima | 355/208 |
| 5,241,347 | 8/1993 | Kodama | 355/246 |
| 5,253,014 | 10/1993 | Matsumoto | 355/208 |
| 5,266,997 | 11/1993 | Nakane et al. | 355/208 |
| 5,305,059 | 4/1994 | Kurosawa | 355/208 |

FOREIGN PATENT DOCUMENTS

| | | |
|---|---|---|
| 59-197032 | 11/1984 | Japan . |
| 4032828 | 2/1992 | Japan . |

*Primary Examiner*—Robert Beatty
*Attorney, Agent, or Firm*—Burns, Doane, Swecker & Mathis, LLP

[57] ABSTRACT

An image density control apparatus which includes a photoreceptor having a photosensitive surface to be uniformly charged to a reference potential and formed with a charge latent image by a reference light amount, a device for developing the charge latent image at a reference developing potential so as to obtain a test pattern, a device for detecting density of the test pattern so as to control image forming condition during an actual image formation according to the detected value. The image density control apparatus further includes a reference condition control device which sets the reference image forming condition for forming the test pattern in accordance with the image forming condition for forming a document which was previously set by detecting a representative density of the document.

6 Claims, 6 Drawing Sheets

IMAGING DENSITY CONTROL APPARATUS

FIELD OF THE INVENTION

The present invention generally relates to an apparatus for executing image density control by AIDC (Auto Image Density Control), and more particularly to an apparatus for optimizing density of a test pattern (reference toner image) by AIDC.

BACKGROUND OF THE INVENTION

The image density control by AIDC is effected, for example, as follows.

In the first place, a photosensitive surface of a photoreceptor is uniformly charged up to a reference potential Vo by a corona charger controlled for its grid potential to a predetermined potential Vg. Subsequently, a predetermined portion of the photoreceptor surface is subjected to light exposure by a reference light amount Lo, whereby a reference charge latent image (potential Vi) is formed. Then, this reference charge latent image is developed with toner into a visible image by a developing unit controlled for its developing potential to a predetermined potential Vb. Thus, after the test pattern has been formed, the density of said test pattern is detected.

During the actual image formation, depending on the degree of deviation of the above detected density from the density in the normal case (i.e., the density of toner image to be formed under the reference image forming condition), the image forming condition (grid potential Vg, light exposure amount Lo, developing potential Vb, toner replenishing amount, etc.) is set.

More specifically, in the conventional image density control based on AIDC, the test pattern is first prepared, and the image forming conditions have been set so that said test pattern is faithfully reproduced.

Accordingly, when the density of the document image to be reproduced is approximately equal to the density of the test pattern, the document may be faithfully reproduced, but in the case where the density of the document image is different from that of the test pattern, there is such an inconvenience that the document density is not faithfully reproduced.

SUMMARY OF THE INVENTION

Accordingly, an essential object of the present invention is to provide an image density control apparatus which is capable of faithfully reproducing density of a document image as far as possible, irrespective of the degree of density of the document image, with substantial elimination of disadvantages inherent in the apparatuses of this kind.

Another object of the present invention is to provide an image density control apparatus of the above described type which is simple in construction and stable in functioning, and can be readily manufactured at low cost.

In accomplishing these and other objects, according to one aspect of the present invention, there is provided an image density control apparatus which includes a photoreceptor having a photosensitive surface to be uniformly charged to a reference potential and formed with a charge latent image by a reference light amount, means for developing said charge latent image at a reference developing potential so as to be visualized into a reference toner image, means for detecting density of said reference toner image so as to control image forming condition during an actual image formation according to the detected value, said image density control apparatus further comprising a reference condition control means which makes the reference image forming condition for forming said reference toner image, while determining image forming condition for forming a toner image with a representative density of a document.

It is to be noted here that in the above arrangement, the representative density of the document may be obtained by preparing a histogram of density distribution through scanning of the document, and in this case, the histogram may be prepared based on the density of the entire region of the document or by designating the region. Similarly, the representative density of the document may be set through designation by input operation from an operating panel or the like.

On the assumption that the representative density of the document is represented by Da, the image forming condition for preparing a toner image of the density Da is first set during preparation of the reference toner image (test pattern). Then, the density of the test pattern as prepared by the above image forming condition is detected, and based on the result of detection, the image forming condition for the actual image formation is set up.

In another aspect of the present invention, there is provided a copying apparatus arranged to form a test pattern image and detect density of the formed test pattern image for copying a document after properly correcting image forming conditions according to the detected density, which includes a detecting means for detecting representative density of the document image, a setting means for setting the image forming conditions according to the detected density, and means for preparing the test pattern based on the set image forming conditions.

In a further aspect of the present invention, there is also provided a copying apparatus arranged to form a test pattern image and detect density of the formed test pattern image for copying a document after properly correcting image forming conditions according to the detected density, which includes a first detecting means for detecting representative density of the document image, a setting means for setting an exposure amount according to the density as detected by the first detecting means, means for preparing the test pattern based on the set exposure amount, a second detecting means for detecting the density of the test pattern, means for properly correcting the image forming conditions according to the density as detected by the second detecting means, and means for forming the document image based on the properly corrected image forming conditions.

In still another aspect of the present invention, there is also provided a method of copying a document image, which includes the steps of detecting a representative density of the document image, setting image forming conditions according to the detected representative density, preparing a test pattern based on the set image forming conditions, detecting density of the test pattern, properly correcting the image forming conditions according to the density of the test pattern, and forming the document image based on the image forming conditions as properly corrected.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
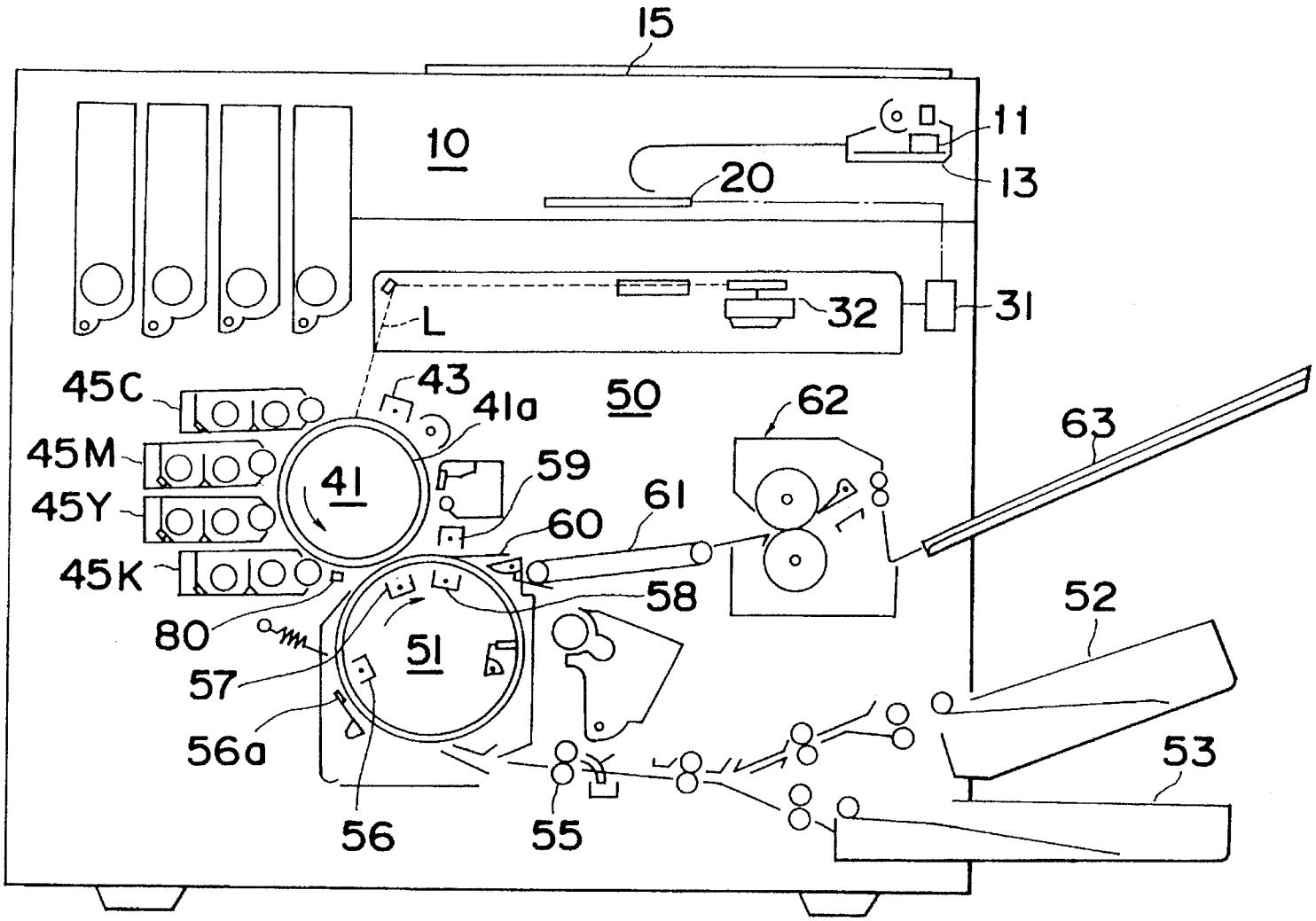
FIG. 1 is a schematic side sectional view of a digital color copying apparatus to which the present invention may be applied.

Before the description of the present invention proceeds, it is to be noted that like parts are designated by like reference numerals throughout the accompanying drawings.

Referring now to the drawings, the present invention will be described in the order as follows, with respect to one preferred embodiment thereof.

(1) Digital color copying apparatus (2) Image signal processing (3) Image density control (1) Digital color copying apparatus In the first place, the general construction of a digital color copying apparatus according to one preferred embodiment of the present invention will be described with reference to FIG. 1.

The digital color copying apparatus of FIG. 1 generally includes an image reading section (image reader section) 10 and an image recording section (printer section) 50.

At the image reading section 10, the document image is read to produce an electrical signal, on the basis of which image data for driving laser diode is produced.

More specifically, the document placed on a document platform 15 of glass or transparent material, with its image surface directed downward, is subjected to light exposure scanning by a scanner 13 displaced by a driving force of a pulse motor (not shown), whereby light reflected by the image is photo-electrically converted into an electrical signal corresponding to densities for R, G and B of the document image by an image sensor (CCD) 11 mounted on the scanner 13. Then, the electrical signal is inputted to an image-signal processing section 20 for predetermined processing so as to be converted to image data for driving the laser diode (The image signal processing will be described more in detail later). Thereafter, this image data is fed to a print head control section 31.

At the image recording section 50, an electrostatic latent image to be written on the photosensitive surface 41*a* of a photoreceptor drum 41 by Laser light L is developed by toners of corresponding color (cyan C, magenta M, yellow Y, black Bk) respectively, and after these toner images are successively overlapped and transferred onto copy paper wound on a transfer drum 51, they are thermally fixed onto the paper sheet by a fixing device 62.

Specifically, in the first place, from a laser device 32 controlled by a print head control section 31 in which the image data referred to earlier has been taken, the laser light L modulated by said image data is outputted. This laser light L is incident upon the photosensitive surface 41*a* of the photoreceptor drum 41 for scanning (main scanning) said surface 41*a* in an axial direction. In such a manner, an electrostatic latent image corresponding to said image data is formed on the photosensitive surface 41*a* of the photoreceptor drum 41. By way of example, if the image data is of the test pattern for AIDC, the electrostatic latent image of the test pattern is formed. It is to be noted that the surface 41*a* of the drum 41 is uniformly charged by a corona charger 43 in a position at an upstream side of incidence of the laser light L, and this charge potential Vo is controlled by a grid potential Vg of the corona charger 43.

The electrostatic latent image formed on the surface 41*a* of the photoreceptor drum 41 is then subjected to reversal development into a visible toner image by any of four developing units (a developing unit 45C for cyan toner, a developing unit 45M for magenta toner, a developing unit 45Y for yellow toner, and a developing unit 45K for black toner). Selection of the developing units to be actuated is instructed by the control section of the image recording section 50. It is to be noted here that toner replenishment to the respective developing units is effected from toner hoppers provided in upper positions corresponding to the respective developing units 45C to 45K and connected through pipes.

Moreover, at a downstream side of the developing unit 45K for the black toner, a photo-sensor 80 for AIDC is provided. By this photo-sensor 80, the densities of the AIDC test pattern and the ground of the surface 41*a* of the photoreceptor 41 are detected, and by controlling the grid potential Vg and the developing potential Vb of the corona charger 43 based on the result of the above detection, the image forming condition during the actual image formation is optimized. Furthermore, in the present embodiment, the density of the test pattern is set at the representative detection density Da of the document (To be described in detail later).

Then, the toner image developed into the visible image as described above is electrostatically transferred onto the paper sheet wound on the transfer drum 51 by an attracting force of a transfer charger 57. This paper sheet is fed from either one of paper sheet cassettes 52 and 53, and after being transported up to a pair of timing rollers 55 through a group of transport rollers, wound onto the transfer drum 51 at predetermined timing. Around said transfer drum 51, an attracting charger 56 for attraction of paper sheets, a ground electrode 56*a* to be held in contact with the paper sheet, erasing chargers 58 and 59 for paper sheet separation and image scattering prevention, and a separating claw 60 for separation of the paper sheet, etc., are sequentially provided. It is to be noted here that the photoreceptor drum 41 and the transfer drum 51 are driven in synchronization with each other by a drum driving motor (not shown).

The paper sheet to which toner images in four colors at the maximum (during full color use) have been transferred, is then separated from the transfer drum 51 and transported to the fixing device 62 by a transport belt 61, and after being subjected to the image fixing treatment by heating at said fixing device 62, discharged onto a paper discharge tray 63 provided outside the copying apparatus. The transport rollers, transport belt 61, etc., are driven by a main motor (not shown).

(2) Image signal processing

Figure 2:
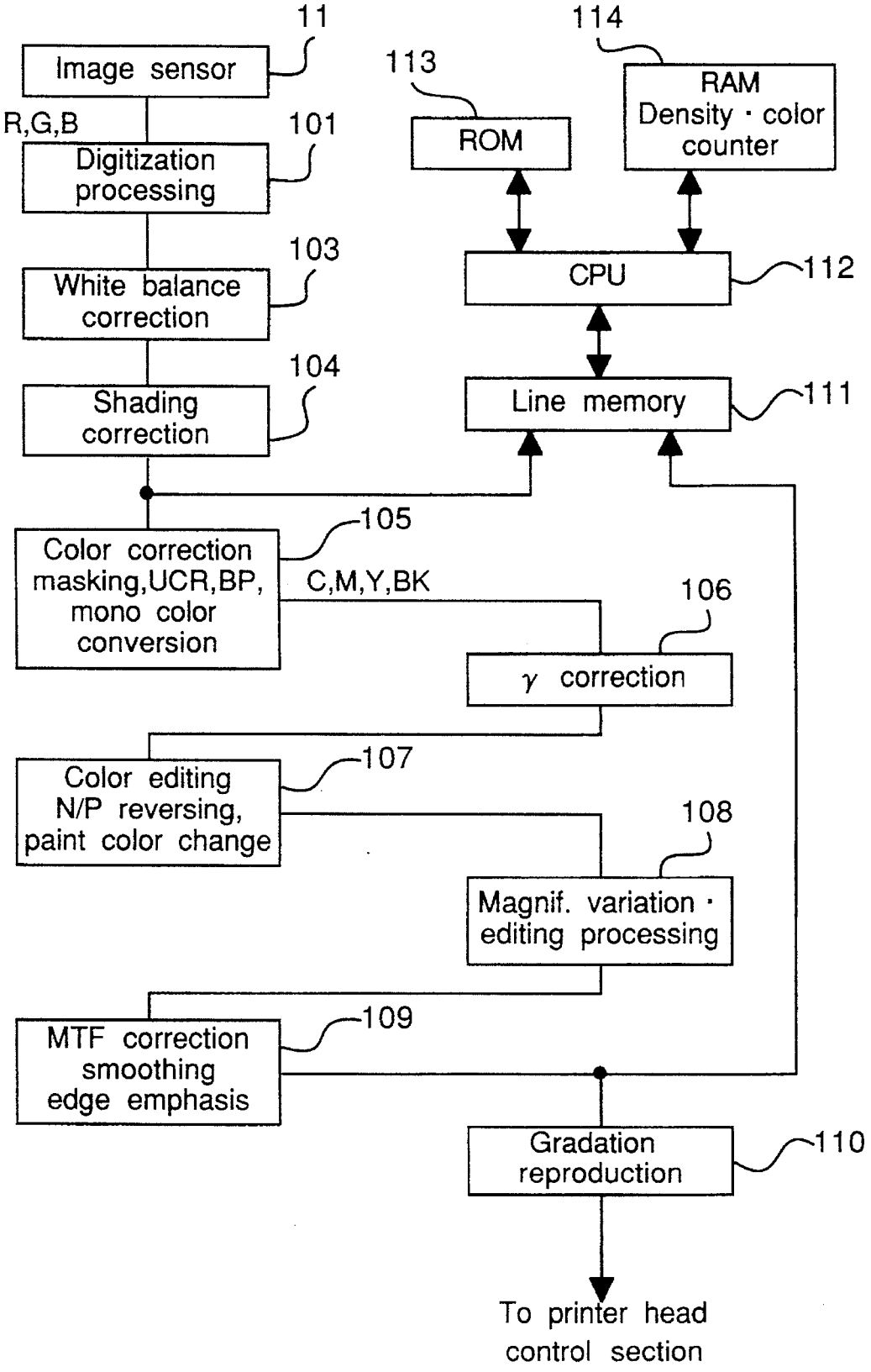
FIG. 2 is a block diagram for explaining image signal processing in the arrangement of the present invention.

Subsequently, referring to FIG. 2, the image signal processing of the copying apparatus of FIG. 1 will be described.

The image sensor 11 serially outputs effective reading pixel signals for 2928 pixels in total for R, G and B.

Each of the above serial signals is subjected to image signal treatment by following processing circuits 101 to 110 which constitute the image signal processing section 20 (FIG. 1) together with a line memory 111, a CPU 112, and a ROM 113 in which the control program is stored.

In the first place, the serial signal is quantized by a digitization processing circuit 101 having a sample hold circuit and an A/D converter so as to be converted into digital data of 8 bits (256 gradations) and further separated into the image data for each color by a latch circuit, and thereafter, inputted into a white balance correction circuit 103.

The image data is standardized by being adjusted for relative ratio between the respective colors by a white balance correction circuit 103 so that an image in a correct tone of color may be formed at the image recording section 50.

Subsequently, correction corresponding to the irregularity in the light amount of the exposure lamp in the main scanning direction and sensitivity difference between the respective elements 12 is effected by a shading correction circuit 104, and data which was the data proportional to the reflective light intensity of the document is subjected to logarithmic conversion based on a visual characteristic after considering the reading range of the document, and is converted into density data proportional to the density of the document.

At a color correction circuit 105, a masking processing for producing density data corresponding to three primary colors Y, M, and C (yellow, magenta, and cyan) of the print toners, a BP processing (black plate formation) for producing density data corresponding to Bk (black), UCR processing (ground color removing), and a mono-color conversion processing are effected. Meanwhile, in a γ-correction circuit 106, a ground removing processing for forming a clear and definite image increased in an entire contrast, and a density adjusting for forming an image with density designated by an operating keys (not shown) are effected.

In a color editing circuit 107, three kinds of processings for color image editing, i.e., negative-positive reversing, color change (color alteration) and painting (painting out), are effected. At a magnification variation and editing processing circuit 108, in order to form varied magnification images enlarged or contracted by a thinning out method and interpolation method, and edited images, for example, by displacement, mirror inversion, etc., processing for varying output timing, output order, and scanning speed in the sub-scanning direction, etc. of the density data signals are effected.

In an MTF correction circuit 109, a smoothing processing for preventing generation of Moiré pattern, and a processing for edge emphasis for eliminating edge loss are effected.

The density data treated for various processings as described above is further subjected to binary processing by an area gradation method at a gradation reproduction circuit 110, and is fed to the image recording section 50 as the image data for laser diode driving. It is to be noted here that the above may be of a light intensity modulation processing.

Moreover, to the CPU 112, a signal is inputted from the sensor 80 for detecting density of the test pattern, while from the CPU 112, control signal for controlling the grid potential Vg and the developing bias Vb is outputted.

(3) Image density control

Subsequently, the image density control effected in the copying apparatus of the present invention will be explained with reference to FIGS. 3 to 5.

Figure 3:
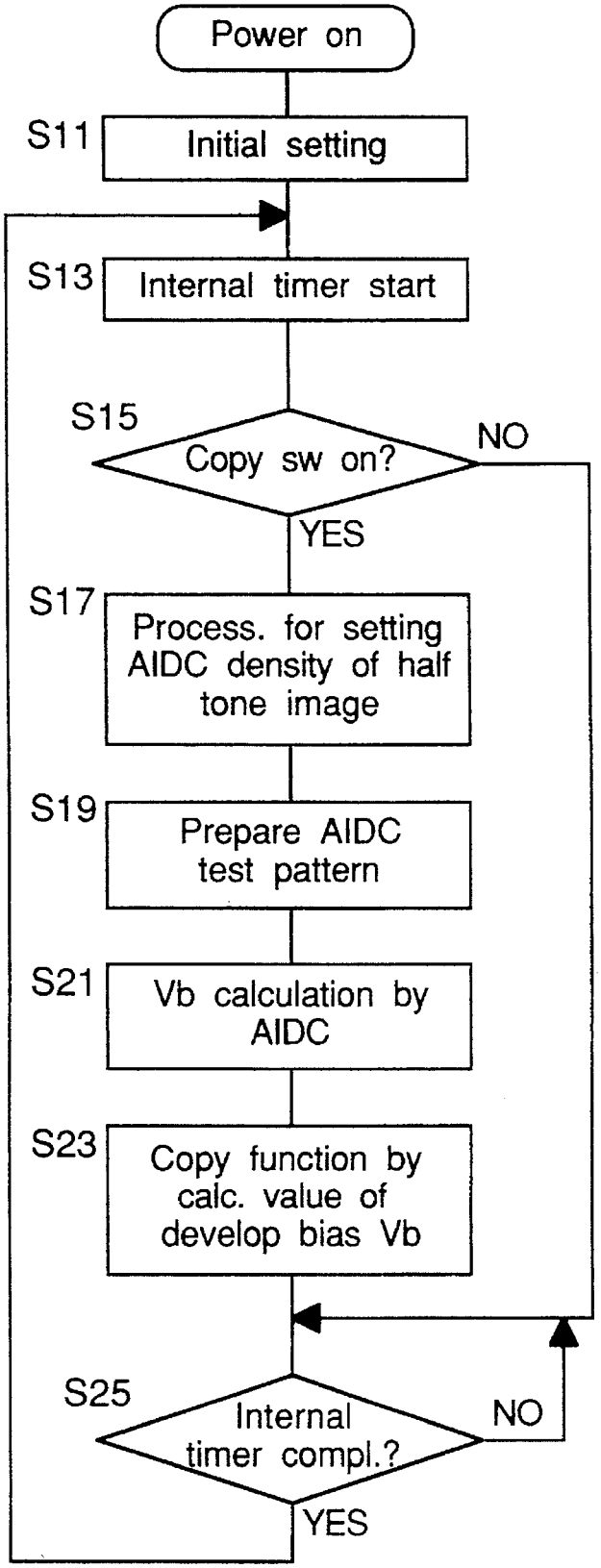
FIG. 3 is a flow-chart for showing an outline of the processing executed by the copying apparatus of FIG. 1.

FIG. 3 is a flow-chart for explaining a main routine showing an outline of the processing in the copying apparatus of the present invention.

In the control section, the processing is started upon turning on a power supply, and the initial setting (S11) is effected.

Then, an internal timer is started (S13), and at each time managed by said internal timer (S25, YES), loop processings are repeatedly effected. Based on the above number of repetitions, various timer counters are counted. Moreover, by these repetitions, the contents of processings are shown in Steps S17 to S23 are successively realized.

The contents of the processings as shown in Steps S17 to S23, are started to be effected by turning on a copy switch (S15, YES).

In the first place, at Step S17, a processing for setting the density of AIDC test pattern at a representative density Da (i.e., density frequently encountered) of the document is effected. The content of this processing will be explained based on FIG. 4.

Upon completion of the setting of the AIDC test pattern density, at Step 19, the test pattern is prepared according to the set test pattern density. The contents of this processing will be described more in detail later with reference to FIG. 5.

Then, the processing for Step S21 is started. Here, the density of the prepared test pattern is detected, and based on the detected density, a processing for calculating the optimum value of the developing potential Vb is effected for the formation of the actual image (FIG. 13).

When the optimum value of the developing potential Vb is calculated based on the density of the test pattern, the processing for Step S23 is started, and after the developing potential Vb is first set to the above optimum value, the actual copying function is executed.

Figure 4:
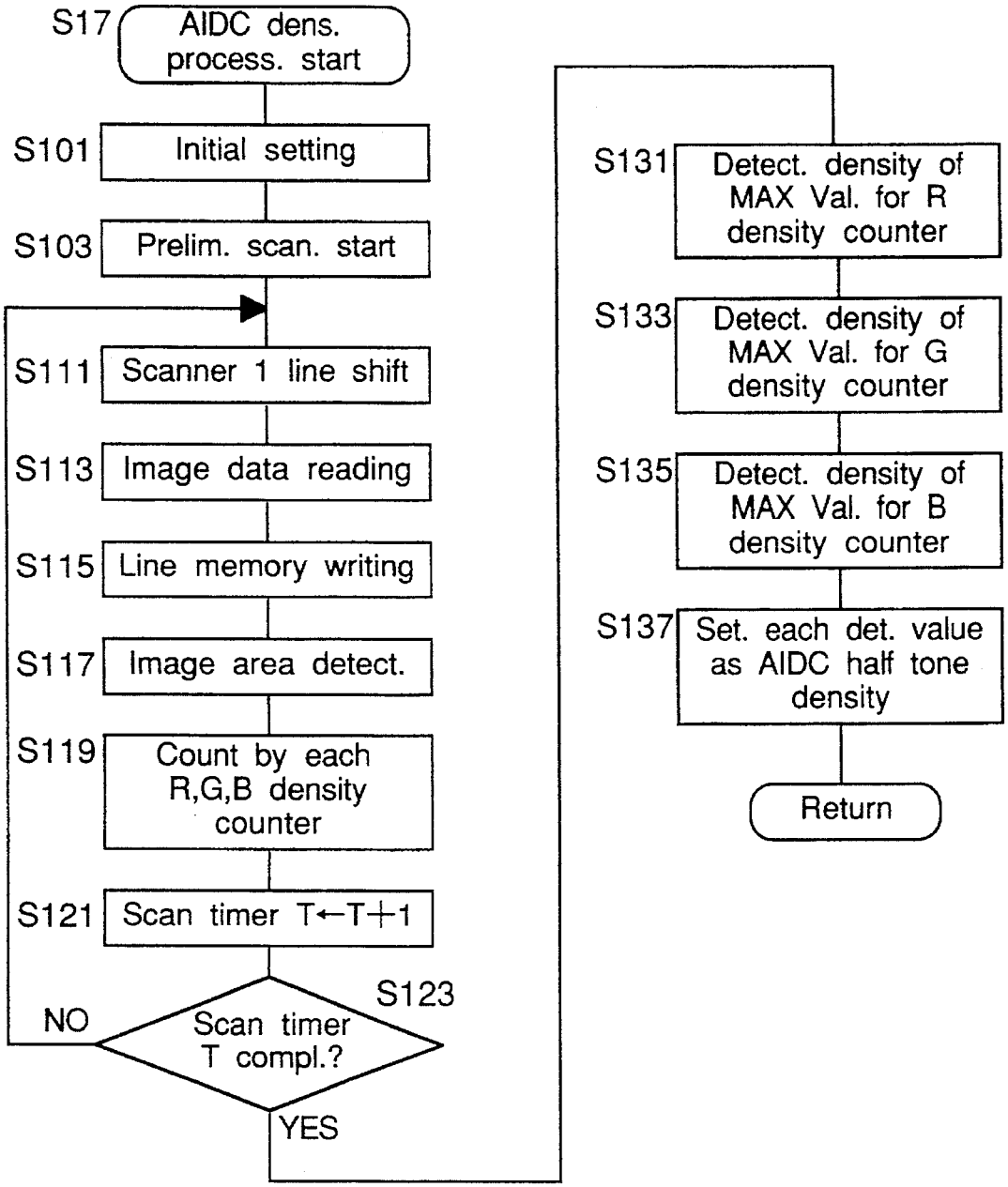
FIG. 4 is also a flow-chart for explaining contents of processing for setting AIDC test pattern density to the representative density of the document (density frequently encountered)Da.
Figure 5:
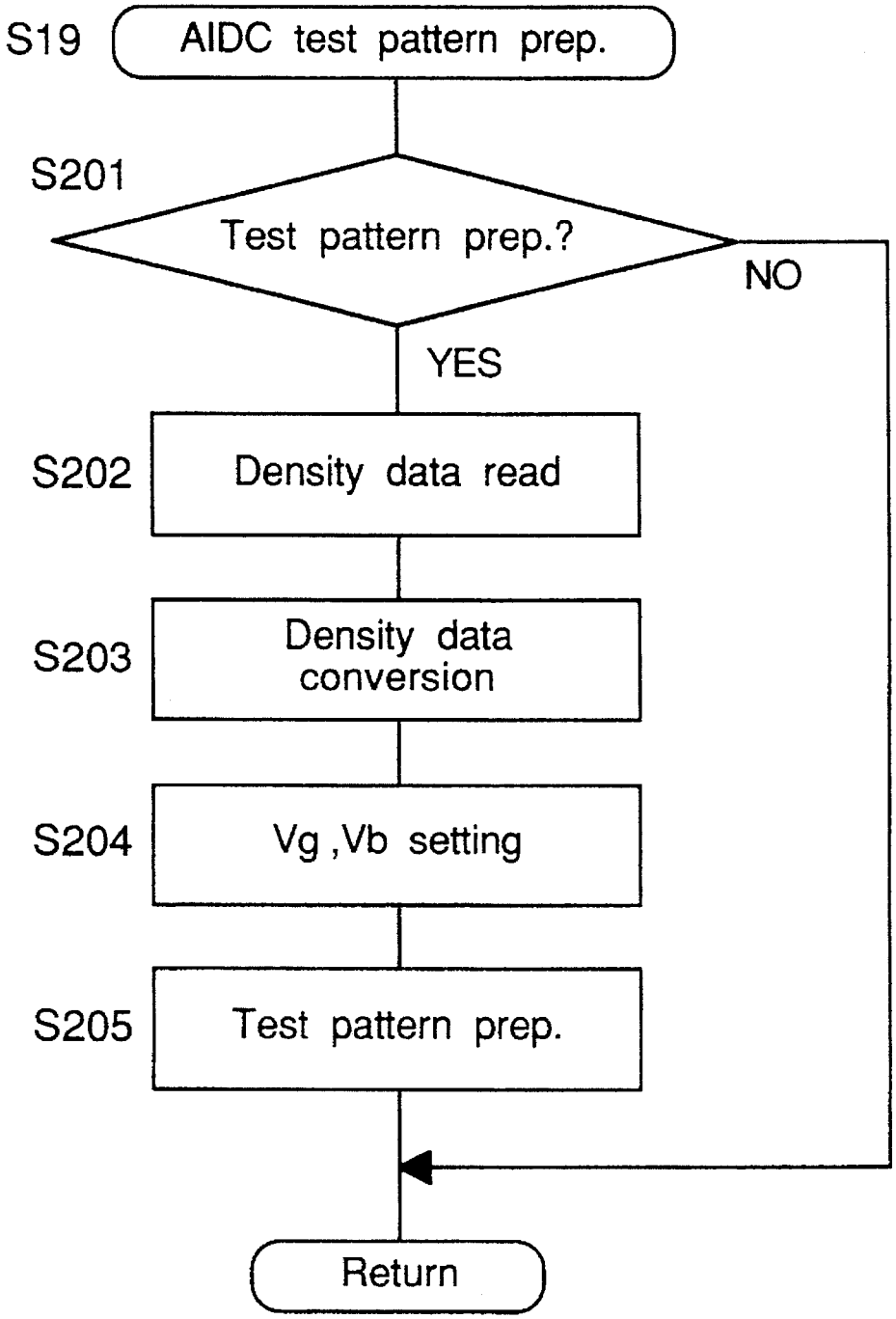
FIG. 5 is also a flow-chart for explaining contents of processing for forming test pattern.

The density of AIDC test pattern is set as in FIG. 4.

Firstly, after initialization for effecting the preliminary scan (S101), said preliminary scan for calculating the representative density Da of the document is started (S103).

Figure 6:
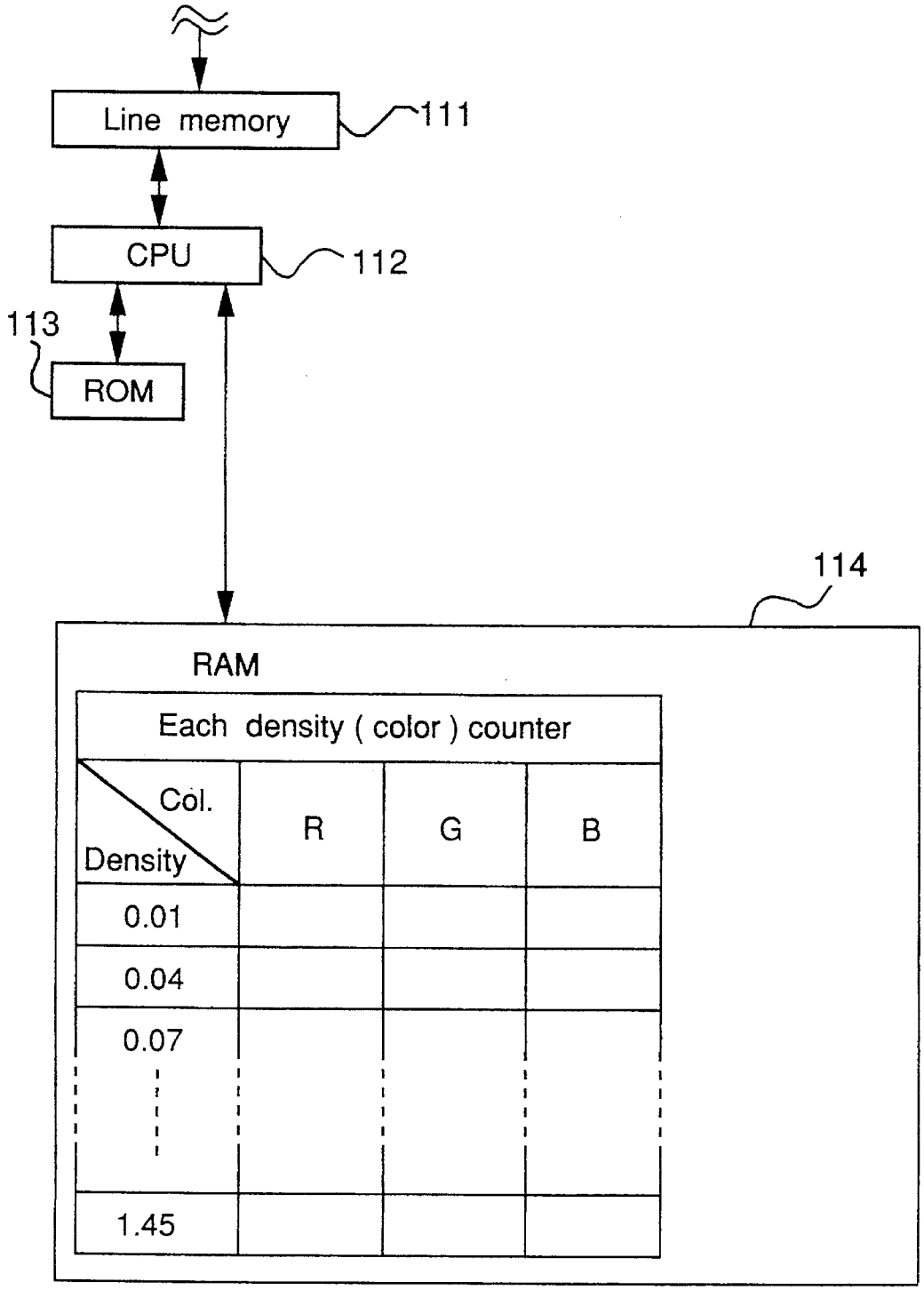
FIG. 6 is a block diagram for explaining RAM in which the document density distribution is stored.

In the preliminary scan, after the scanner 13 (FIG. 1) is displaced by an amount for 1 line (S111), the signal of said line is read and processed by the image signal processing section 20 as described earlier so as to be converted into the density data (S113), and said density data is written in the line memory (S115), and thus, the image area is detected (S117). With respect to each density data of such detected image area, each density level is judged according to R, G and B for counting by each level, and the result is stored in the RAM 114 for each color and density level (S119) as shown in FIG. 6, with a histogram being thus prepared.

Then, a scan timer is counted up (S121), and processings similar to the above are effected with respect to the next line (S111 to S121).

Thereafter, when the scan timer counts up (S123, YES), the density with the highest count value is detected according to R, G and B based on the data stored in the RAM 114 (S131 to S135). It is to be noted here that "the density with the highest count value" means the representative density of the document.

Thus, upon detection of the density with the highest count value, said density is set as the density for the AIDC test pattern and is stored in the RAM 114 (S137), whereby the present processing is completed, and the processing at Step S19 in FIG. 3 is started as described earlier.

Subsequently, with reference to FIG. 5, preparation of the test pattern to be executed at Step S19 will be explained.

At Step S201, when the timing for starting the test pattern preparation is detected, the test pattern data stored in the RAM 114 at Step S137 referred to earlier in FIG. 4 are read respectively for R, G and B, and converted into the density data of the print toner colors Y, M, C and BK (Step S202). Then, at Step S203, these density data are converted into the exposure amount of the laser beam. More specifically, a Table indicating the relation between the image density and exposure amount when the grid potential Vg of the corona charger and developing bias are in the reference condition, is stored each for Y, M, C and Bk as represented by Table 1 (Y table) as shown below, and by sequentially referring to these Tables, the exposure amount each for Y, M, C and Bk is obtained.

TABLE 1

(Table for Y)

| Image density | Exposure amount |
|---|---|
| 0.01 | 20 |
| 0.04 | 21 |
| 0.07 | 22 |
| . | . |
| . | . |
| . | . |
| 1.45 | 255 |

Then, at Step S204, the grid potential Vg and the developing bias Vb are set to the reference conditions, and at Step S205, by using the exposure amount of Y, M, C, and Bk as the image data, the test pattern each for Y, M, C and Bk is prepared.

It should be noted here that in the above embodiment, although the representative density Da of the document is obtained by reading the document for counting according to the density level and color, and detecting the density with the highest count value according to colors, the arrangement may, for example, be so modified that the representative density is inputted through an operating panel, etc.

Moreover, in the above embodiment, although the density is detected with respect to the all region of the document, this may, for example, be so modified to designate the region to be detected by an editor or the like.

As is clear from the foregoing description, according to the image density control apparatus of the present invention, the image forming condition for preparing the toner image at the representative density of the document is set for preparing the test pattern, and AIDC is effected by detecting the density of the test pattern.

Therefore, the representative density of the document can be faithfully reproduced, and consequently, the document is favorably reproduced on the whole.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A copying apparatus arranged to form a test pattern image and detect density of the formed test pattern image for copying a document after properly correcting image forming conditions according to the detected density of the formed test pattern image, said copying apparatus comprising:

detecting means for detecting a representative density of a document image, setting means for setting image forming conditions according to the detected density, and means for preparing a test pattern based on the set image forming conditions.

2. A copying apparatus as claimed in claim 1, wherein said detecting means is arranged to sample the density of the document image and set the image density most frequently encountered as the representative density.

3. A copying apparatus arranged to form a test pattern image and detect density of the formed test pattern image for copying a document after properly correcting image forming conditions according to the detected density, said copying apparatus comprising:

a first detecting means for detecting representative density of the document image, a setting means for setting an exposure amount according to the density as detected by the first detecting means, means for preparing the test pattern based on the set exposure amount, a second detecting means for detecting the density of the test pattern, means for properly correcting the image forming conditions according to the density as detected by the second detecting means, and means for forming the document image based on the properly corrected image forming conditions.

4. A copying apparatus as claimed in claim 3, wherein said first detecting means is arranged to sample the density of the document image and set the image density most frequently encountered as the representative density.

5. A method of copying a document image, which comprises the steps of:

detecting a representative density of the document image, setting image forming conditions according to the detected representative density, preparing a test pattern based on the set image forming conditions, detecting density of the test pattern, properly correcting the image forming conditions according to the density of the test pattern, and forming the document image based on the image forming conditions as properly corrected.

6. An image density control apparatus which includes a photoreceptor having a photosensitive surface to be uniformly charged to a reference potential and formed with a charge latent image by a reference light amount, means for developing said charge latent image at a reference developing potential so as to be visualized into a reference toner image, means for detecting density of said reference toner image so as to control image forming condition during an actual image formation according to the detected density, said image density control apparatus further comprising a reference condition control means which sets the reference image forming condition for forming said reference toner image according to a representative density of a document to be copied.

* * * * *